United States Patent [19]

Ohmatsu

[11] Patent Number: 4,833,851

[45] Date of Patent: May 30, 1989

[54] EXPANSION JOINTS

[76] Inventor: Toshikazu Ohmatsu, 18-22 Chuo, 1-Chome, Nishi-ku, Yokohama, Japan

[21] Appl. No.: 60,550

[22] Filed: Jun. 11, 1987

[51] Int. Cl.[4] ..... E04B 1/68; E04F 15/14

[52] U.S. Cl. ..... 52/396; 52/109; 52/573; 404/52; 404/56

[58] Field of Search ..... 52/109, 395, 396, 573; 14/16.5; 404/47, 52, 53, 54, 55, 56, 57, 58, 59, 67, 68, 69, 74

[56] References Cited

U.S. PATENT DOCUMENTS

| | | | |
|---|---|---|---|
| 2,321,873 | 6/1943 | Tate | 404/47 |
| 3,183,626 | 5/1965 | Schmitt | 52/395 |
| 3,245,328 | 4/1966 | Fasslinder | 52/396 |
| 3,344,720 | 10/1967 | Hallock | 404/47 |
| 3,371,456 | 3/1968 | Balzer et al. | 52/395 |
| 3,390,501 | 7/1968 | Driggers | 52/395 |
| 3,648,423 | 3/1972 | Cole | 52/109 |
| 4,557,082 | 12/1985 | Dunsworth | 52/109 |
| 4,616,954 | 10/1986 | Taga | 52/396 |

*Primary Examiner*—Michael Safavi
*Attorney, Agent, or Firm*—Schwartz & Weinrieb

[57] ABSTRACT

An expansion joint comprises a pair of support bases having a rail type shape lack of which is continuous in the longitudinal direction and is fixed to each edge of both members of a building defining an expansion joint gap, a plurality of connecting members for connecting both support bases together so that the gap between the bases is expansible or contractible, and a cover plate of a proper length connected to the connecting members so as to span the expansion joint gap while being disposed atop the upper ends of both support bases which are slideable with respect to the cover plate under expansion and contraction conditions and which are formed with concave portions for accommodating a finish material on the internal surface side, whereby a surface material substantially identical with a surface material of the members of the building adjacent the expansion joint may be disposed within the concave portion for accommodating the finish material of the cover plate so as to integrate its appearance with respect to that of the building members.

20 Claims, 4 Drawing Sheets

EXPANSION JOINTS

FIELD OF THE INVENTION

This invention relates to an expansion joint covering a gap for absorbing distortion formed on a floor surface or wall surface or ceiling and the like of a building.

BACKGROUND OF THE INVENTION

Heretofore, in the case of buildings, especially, high-rise buildings or large size buildings, expansion gaps are formed within the floor surface, wall surface or ceiling and the like of a building. Each gap is formed with a view to prevent breakage of the building by its absorption of any distortion as a result of expansion or contraction due to temperature changes within the building or irregular foundation support or distortion as a result of an earthquake and the like, and as a structure for covering the gap, the expansion joint shown in FIG. 8 has heretofore been used. The expansion joint of this kind is constructed in such a way that a cover plate 51 is fixed to a pair of support bases 50 fixed to ends of members A, A' of a building sandwiching a gap G, and in general, a connecting means 52 flexibly connects both support bases 50, 50 so as to span the gap G, and the cover plate 51 of the flat plate type is connected to the connecting means 52 by means of a bolt 53.

Accordingly, when the cover plate 51 was made of a metal plate, there was a problem that the design of the floor surface or wall surface or ceiling surface and the like of the building was divided by means of the cover plate 51 extending along the gap G. Especially, in recent years, as the width of the gap G is becoming larger as a result of a tendency of constructing larger size buildings, the width of the cover plate 51 is becoming correspondingly wider thereby producing a sense of design incompatibility in some cases.

SUMMARY OF THE INVENTION

This invention therefore provides an expansion joint which eliminates the foregoing problems and has features such the free selection of surface materials suitable with the adjacent floor surface or wall surface and having excellent design harmony.

This invention has been achieved to solve the foregoing problems, and the surface of the cover plate is formed with a concave portion of a proper depth for accommodating the finish material which is substantially, and a surface material identical with the surface material of the members of a building adjacent the expansion joint is disposed within the concave portion for accommodating the finish material.

The solving of the problems can be achieved by this invention in the following manner.

Namely, this invention relates to an expansion joint comprising a pair of support bases having a rail type shape which is continuous in the longitudinal direction and being fixed to each edge of both members defining the expansion gap, a plurality of connecting means for connecting both support bases together so that the gap between the bases is expansible and contractible, and a cover plate of a proper length connected to the connecting means for spanning the expansion gap is slideably disposed upon the upper ends of both support bases and is formed with a concave portion for accommodating a finish material on the outer surface side, whereby a surface material substantially identical with the surface material of the members of a building disposed adjacent the expansion joint is disposed within the concave portion for accommodating the finish material of the cover plate so as to integrate its appearance with respect to the entire appearance of the building surface.

By the foregoing construction, the surface of the cover plate can be fitted with a desired surface material suitable for a design, whereby for example, a mosaic pattern drawn on the wall surface can be expressed in continuity on the surface of the expansion joint, whereby an integration of the cover plate with the adjacent surface materials of the members of the building can be achieved.

BRIEF DESCRIPTION OF THE DRAWINGS

Various changes and modifications of this invention are feasible on the basis of similar objectives and identical principles, and a concrete embodiment of this invention will be described in the following detailed description by referring to the attached drawings, wherein.

DETAILED DESCRIPTION OF THE PREFERRED EMBODIMENT

Figure 1:
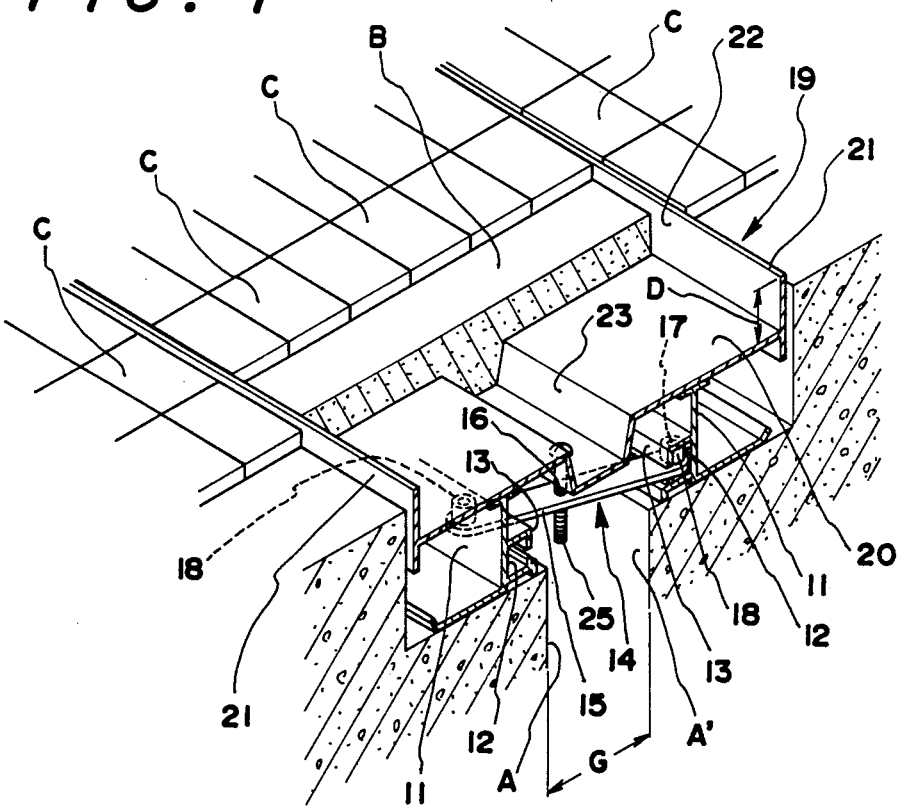
FIG. 1 is a perspective view of a first embodiment of an expansion joint of this invention in which a part of the expansion joint in place is cut away.
Figure 3:
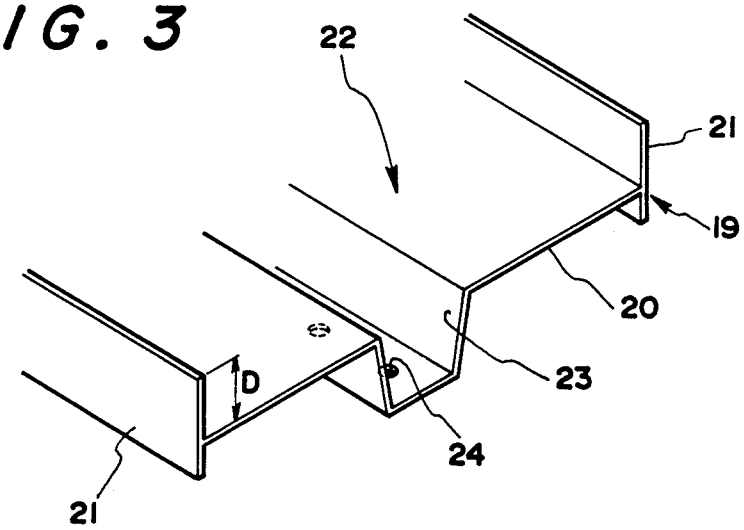
FIG. 3 is a perspective view of the cover plate.
Figure 2:
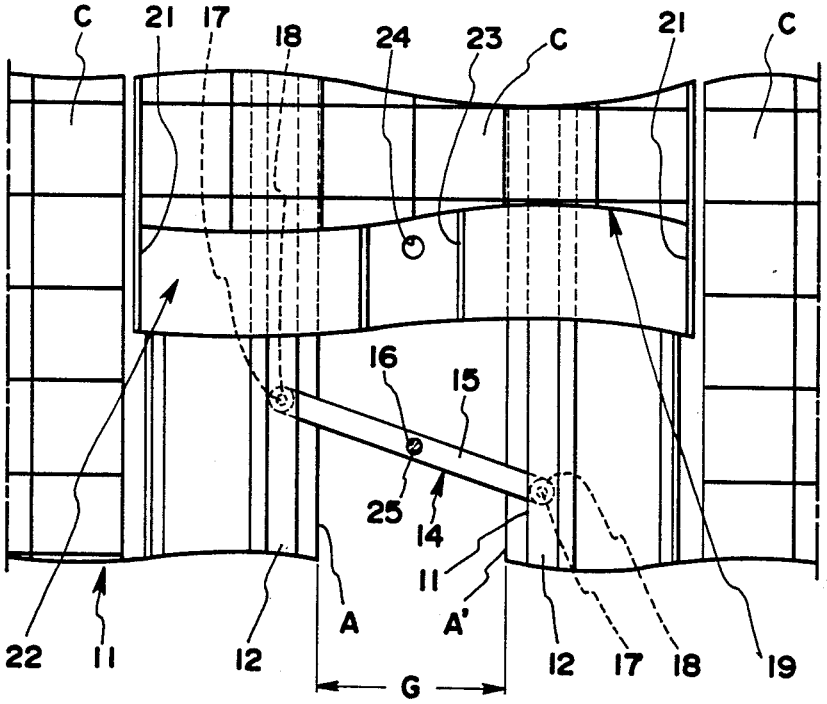
FIG. 2 is a view showing a condition of the surface material being disposed upon the cover plate.

FIG. 1 through FIG. 3 show the first embodiment of the expansion joint of this invention.

Reference numeral 11 denotes a rail type support base made from an aluminum frame member having an L-shaped cross section, and a slide groove 12 extending in the longitudinal direction is integrally formed on one side surface thereof, and the slide groove 12 is defined by means of oppositely disposed edges 13, 13. Each support base 11 is constructed in such a way that two support bases 11, 11 having their slide grooves 12 disposed opposite each other are fixed substantially parallel with respect to each other along each end portion of members A, A' of a building defining the gap G therebetween. The space between the slide grooves 12, 12 of both the support bases 11, 11 is connected by a connecting means 14, and the lifting hook 14 is constructed in such a way that rollers 18, 18 are mounted upon both ends of a connecting rod 15, formed with a threaded hole 16 at its center, by means of pins 17. Each roller 18 is disposed toward the gap G by means of the engaging edges 13 when it is internally inserted into the slide groove 12, and is axially confined so as to slide freely in the direction of the groove, and the length of the connecting rod 15 is set so that the connecting rod 15 is disposed at an angle with respect to the longitudinal direction of the grooves 12 when both the rollers 18, 18 are engaged within the slide groove 12, 12 of both the support bases 11, 11. The reference numeral 19 denotes a cover plate made from an aluminum frame member or aluminum mold member, and the edge portions 21, 21 formed at both side edges of a bottom plate 20 are disposed substantially perpendicular to bottom plate 20 whereby a concave portion 22 for accommodating the finish material having a proper depth D is formed. In addition, small holes 24, 24 . . . are formed with a suitable spacing therebetween within the concave groove 23 extending in the longitudinal direction which is formed within the center of the bottom plate 20, and a bolt 25 inserted through each small hole 24 is threadedly engaged within each threaded hole 16 of each connecting means 14 so as to connect and fix the cover plate in a condition where the cover plate 19 rides over both the support bases 11, 11.

The cover plate 19 is arranged to have the concave portion 22 support finish material which may comprise a plurality of identical tiles C, for example, in case tiles C are also used as the surface materials of the members A, A′ of a building. In such case, it is noted that the upper surface of the side plates 21 of the cover plate 19 will be substantially the same level of height as that of the tiles C. As a base material B for the tiles C, a variety of materials such as mortar and the like may be used.

Still further, while the cover plate 19 of the foregoing construction may be formed with a concave portion 22 for supporting the finish material so that the objectives of this invention can be achieved, in order to improve the support property of the surface material such as tile and the like upon the concave portion, the following various modifications may be made.

Figure 4:
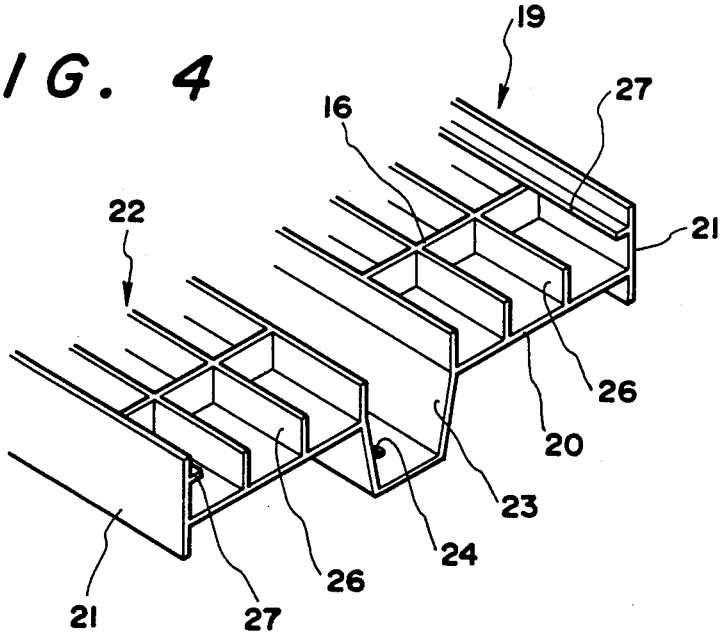
FIG. 4 through FIG. 7 are perspective views of the cover plate showing other embodiments thereof.

The cover plate 19 shown in FIG. 4 is suitable for use upon a wall surface and the like in view of the fact that a grid like rib system 26 having a proper height is formed within the concave portion 22 so as to support the finish material upon the bottom plate 20 In addition, an inwardly directed edge 27 is formed upon each edge portion 21, and thus, separation of the cover plate 19 from the finish material is prevented by being firmly fixed to the surface material and the base material deposited within the concave portion 22 which supports the finish material. Furthermore, if necessary, the cover plate 19 may be used by bonding and fixing a metal lath net-type member upon the surface of the rib 26.

Figure 5:
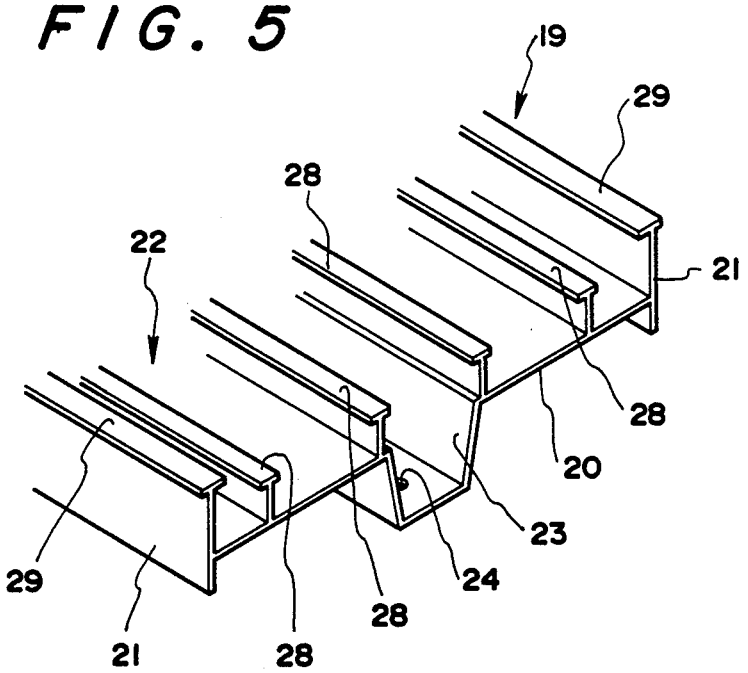

The cover plate 19 is shown in FIG. 5 is constructed in such a way that a plurality of engaging ribs 28, 28 . . . each of whose cross section is of a T-shape and extending in the longitudinal direction are integrally formed in an upstanding manner upon the bottom plate 20 so as to be disposed within the concave portion 22 for supporting the finish material upon the bottom plate 20 and overhanging ledges 29 are formed upon each edge portion 21 so that the cover plate 19 is suitable for use on the ceiling portion and the like.

Figure 6:
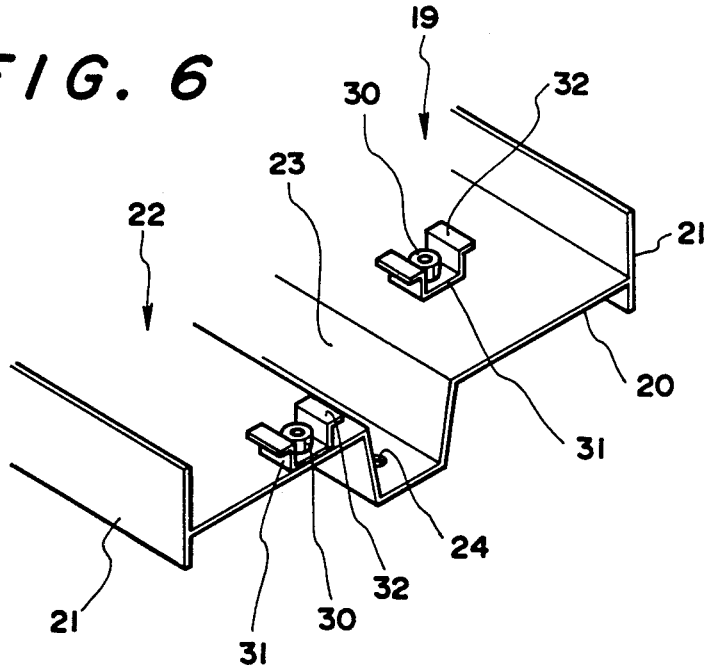

The cover plate 19 shown in FIG. 6 is constructed in such a way that an engaging hook 31 having an engaging flange portion 32 is fixed to the bottom plate 20 by means of a bolt and nut assembly 30.

Figure 7:
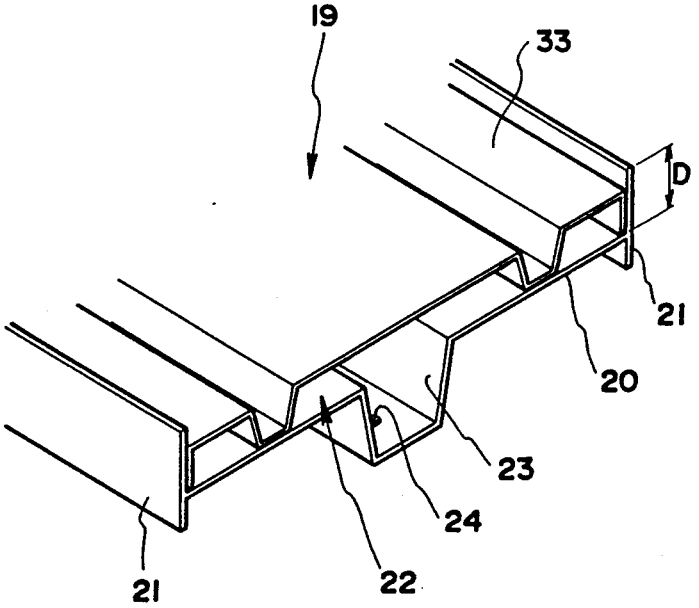
Figure 8:
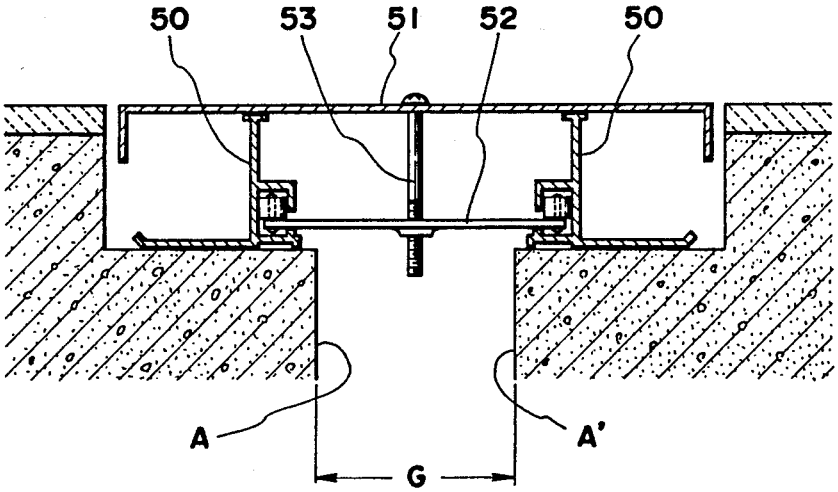
FIG. 8 (PRIOR ART)
FIG. 8 is an elevational cross section showing a conventional expansion joint.

Continuing further, the cover plate 19 of this invention may be constructed in such a way that a height elevating plate 33 that reduces the depth D is adapted to be fixed within the concave portion 22 for supporting the finish material as shown in FIG. 7 so that a cover plate 19, which is light in weight as a result of the hollow spaces defined between the bottom plate 20 and the elevating plate 33, can be obtained.

As described in the foregoing, in this invention, since the surface of the cover plate is covered with the desired surface material, a surface material identical with the surface material of the members of a building adjacent the expansion joint can be used and also, the integration of its appearance can be achieved.

In the specification, the concrete description of the embodiments of the examples set out in the paragraphs of the Detailed Description of the Preferred Embodiment of this invention are provided merely for clarifying the technical contents of this invention, and this invention has been described in detail to a certain degree but with respect to the embodiments, various changes or modifications can be made without departing from the spirit and the scope of this invention to be claimed hereinafter.

What is claimed is:

1. An expansion joint for spanning a gap defined between sections of a static structure which may experience movements relative to each other under expansion or contraction conditions, said static structure sections including external surface finishing material, comprising:

a pair of support bases respectively fixed to said static structure sections;

connection means movably connected to said pair of support bases for accommodating movement of said pair of support bases and said static structure sections under said expansion and contraction conditions; and cover means connected to said connection means for covering said gap defined between said static structure sections;

said cover means including a base plate, and side plates connected to opposite ends of said base plate and extending substantially perpendicular to said base plate so as to define with said base plate a substantially U-shaped cavity filled with external surface finishing material which is substantially similar to said external surface finishing material defining said static structure sections whereby substantial visual continuity defined between said static structure sections and across said expansion joint is substantially maintained, said side plates being disposed immediately adjacent and substantially in contact with said static structure sections under said contraction conditions and having upper ends thereof substantially flush with said external surface finishing material of said static structure sections and said external surface finishing material of said expansion joint cavity so as to separate said external surface finishing material portions of said static structure sections from said external surface finishing material portion of said expansion joint cavity and thereby define visible lines of demarcation of said expansion joint as defined between said external surface finishing material of said static structure sections and said external surface finishing material of said expansion joint as housed within said substantially U-shaped cavity of said expansion joint.

2. An expansion joint as defined in claim 1, in which:

said external finish surface material disposed within said cavity of said cover means is identical with said surface material of said static structure sections disposed adjacent to said expansion joint.

3. An expansion joint as defined in claim 1, in which:

an external surface finishing material engaging structure having a grid-type structure is formed upon said cavity portion of said cover means.

4. An expansion joint as set forth in claim 3, wherein:

said grid-type structure comprises longitudinally and laterally extending ribs integrally formed in an upstanding manner upon said base plate of said cover means.

5. An expansion joint as defined in claim 1, in which:

an external surface finishing material engaging structure comprising an edge portion projecting laterally inwardly from said side plates is disposed within said cavity portion of said cover means so as to prevent separation of said external surface finishing material disposed within said cavity portion of said cover means from said cover means.

6. An expansion joint as defined in claim 1, in which:

a height elevating plate is disposed within said cavity portion of said cover means so that the depth of said cavity portion is reduced.

7. An expansion joint as set forth in claim 1, further comprising:

substantially T-shaped, longitudinally extending rib means integrally formed in an upstanding manner upon said base plate of said cover means for engaging said external surface finishing material disposed within said cavity portion of said cover means.

8. An expansion joint as set forth in claim 1, further comprising:

hook means fixed to said base plate of said cover means for engaging said external surface finishing material disposed within said cavity portion of said cover means.

9. An expansion joint as set forth in claim 1, wherein:

said support bases include longitudinally extending rail-type members having longitudinally extending grooves defined therein; and said connection means includes pivotably movable rod-type plates having roller means fixed upon opposite ends thereof for engagement within said grooves of said rail-type members.

10. An expansion joint as set forth in claim 1, wherein:

said cover means is disposed atop said support bases in a relatively free-sliding manner so as to permit said support bases to slideably move with respect to said cover means along with said static structure sections under said expansion and contraction conditions.

11. An expansion joint for spanning a gap defined between sections of a static structure which may experience movements relative to each other under expansion or contraction conditions, said static structure sections including external surface finishing material, comprising:

a pair of support bases respectively fixed to said static structure sections;

means movably cooperative with said pair of support bases for accommodating movement of said pair of support bases and said static structure sections under said expansion and contraction conditions; and cover means, mounted upon said support bases, for covering said gap defined between said static structure sections;

said cover means including a base plate, and side plates connected to opposite ends of said base plate and extending substantially perpendicular to said base plate so as to define with said base plate a substantially U-shaped cavity filled with external surface finishing material which is substantially similar to said external surface finishing material defining said static structure sections whereby substantial visual continuity defined between said static structure sections and across said expansion joint is substantially maintained, said side plates being disposed immediately adjacent and substantially in contact with said static structure sections under said contraction conditions and having upper ends thereof substantially flush with said external surface finishing material of said static structure sections and said external surface finishing material of said expansion joint cavity so as to separate said external surface finishing material portions of said static structure sections from said external surface finishing material portion of said expansion joint cavity and thereby define visible lines of demarcation of said expansion joint as defined between said external surface finishing material of said static structure sections and said external surface finishing material of said expansion joint as housed within said substantially U-shaped cavity of said expansion joint.

12. An expansion joint as set forth in claim 11, wherein:

said external surface finishing materials of said static structure sections and said expansion joint cavity are substantially identical.

13. An expansion joint as set forth in claim 11, wherein said base plate of said cover means further comprises:

upstanding, longitudinally and laterally extending rib members defining a grid structure within said cavity of said cover means for engaging said external surface finishing material disposed within said U-shaped cavity of said cover means.

14. An expansion joint as set forth in claim 11, further comprising:

ledge means integrally formed upon an upper portion of each of said side plates of said cover means and extending laterally inwardly into said cavity portion of said cover means for engaging said external surface finishing material disposed within said U-shaped cavity of said cover means so as to prevent separation of said cover means from said external surface finishing material disposed within said cavity.

15. An expansion joint as set forth in claim 11, further comprising:

longitudinally extending, upstanding ribs, having a substantially T-shaped cross-section, integrally formed upon said base plate of said cover means for engaging said external surface finishing material disposed within said cavity of said cover means so as to prevent separation of said cover means from said external surface finishing material disposed within said cavity.

16. An expansion joint as set forth in claim 11, further comprising:

said cavity of said cover means has a predetermined depth dimension; and corrugated height-elevating plate means disposed within said cavity portion of said cover means and atop said base plate for reducing said depth dimension of said cavity portion of said cover means whereby a reduced amount of said external surface finishing material may be accommodated within said cavity portion of said cover means.

17. An expansion joint as set forth in claim 11, wherein:

said support bases comprise longitudinally extending rail-type members having longitudinally extending grooves defined therein; and said movably cooperative means comprises pivotably movable rod-type plates having roller means fixed upon opposite ends thereof for engagement within said grooves of said rail-type members of said support bases.

18. An expansion joint as set forth in claim 17, wherein:

said pivotably movable rod-type plates are disposed at a predetermined angle with respect to the longitudinal extent of said rail-type members and said grooves so as to be pivotably movable under said expansion and contraction conditions.

19. An expansion joint as set forth in claim 11, wherein:

said cover means is connected to said movably cooperative means.

20. An expansion joint as set forth in claim 11, wherein:

said support bases are slideably disposed beneath said cover means so as to be movable relative to said cover means under said expansion and contraction conditions.

* * * * *